US005833075A

United States Patent [19]

Czaplinski et al.

[11] Patent Number: 5,833,075

[45] Date of Patent: Nov. 10, 1998

[54] RACK FOR KITCHEN WARE

[76] Inventors: Cheryl E. Czaplinski, 710 Downview Crescent, Oshawa, Ontario, Canada, L1H 7W1; Bernie Grafe, 92 Church Street South, Suite 211, Ajax, Ontario, Canada, L1S 6B4

[21] Appl. No.: 833,086

[22] Filed: Apr. 4, 1997

[51] Int. Cl.[6] ..... A47F 7/00

[52] U.S. Cl. ..... 211/41.2; 211/41.3; 211/41.8

[58] Field of Search ..... 211/41.2, 124, 211/41.3, 41.4, 41.8, 41.1, 41.5, 41.6

[56] References Cited

U.S. PATENT DOCUMENTS

| | | | |
|---|---|---|---|
| 628,409 | 7/1899 | Mendenhall | 211/41.8 X |
| 1,165,724 | 12/1915 | Smith | 211/41.3 X |
| 2,433,823 | 12/1947 | Lindeblad | 211/41.8 X |
| 3,889,815 | 6/1975 | Merle | 211/41.1 |
| 4,079,840 | 3/1978 | Usner | 211/124 |
| 4,733,781 | 3/1988 | Gerlach . | |
| 5,205,419 | 4/1993 | Purtilo | 211/41.1 |
| 5,332,105 | 7/1994 | Stanfield | 211/41.4 |
| 5,497,890 | 3/1996 | Clark | 211/41.8 |

*Primary Examiner*—Robert W. Gibson, Jr.

[57] ABSTRACT

The rack retains objects such as lids or other generally like-shaped items for washing and drying in a dishwasher or for sterilizing in a pot or pan of boiling water. The rack has a frame having up-standing dividers spaced apart from one another at regular intervals for receipt of the objects therebetween. The frame also has a pair of trunnions, a stop member and a groove formed therein. The rack includes a retainer having a pair of lateral supports pivotally mounted to the frame and a number of spaced bars attached to the supports and extending therebetween. Each support has a slot within which a trunnion is slidably received. The retainer swings about the trunnions from a closed position in which the bars are over the objects and prevent them from being removed from between the dividers to an open position in which the bars are beside the objects and allow them to be selectively inserted and removed from between the dividers. One of the supports has a boss which contacts the stop member when the retainer is in the closed position. The retainer when in the closed position being, with respect to the trunnions, selectively slidable downward to cause the boss to enter the groove and upward to withdrawn the boss therefrom. When the boss is in the groove it secures the retainer in the closed position.

5 Claims, 3 Drawing Sheets

RACK FOR KITCHEN WARE

BACKGROUND OF THE INVENTION

This invention relates to racks for kitchen ware which is to be washed and dried. More particularly the invention relates to racks which permit kitchen ware such as lids, plates, saucers or other generally like-shaped items to be washed and dried in a dishwasher or sterilized in a pot of hot water.

A cleaning and drying device for kitchen ware such as a dishwasher operates most effectively when the items to be washed and dried are held firmly in position. If they are not, the items may not be properly cleaned and dried or they may be damaged during the washing or drying cycle.

Racks in conventional dishwashers are designed to firmly secure dishes, glasses and other items commonly used in the preparation and serving of meals. The racks are not designed however to firmly hold many items not so commonly used. For example nipples for baby bottles and small lids such as lids for preserve jars are usually not washed and dried very well in a dishwasher because they are not held securely in a conventional rack. If they are placed in such a rack they will be thrown about the interior of the dishwasher by the force of the washing water or the force of the air used for drying. Many will settle in the bottom of the dishwasher where they will be in contact with dirty water from the washing cycle.

Racks which are designed to hold specific items are known. For example U.S. Pat. No. 4,830,200 to Zambano et al. describes a rack which is specifically designed to hold nipples of baby bottles. U.S. Pat. No. 5,344,029 to Oghia et al. shows a rack which is intended to hold tall items and lids.

The racks described in the above-noted patents are not suitable for holding a large number of small lids such as the lids of preserve jars. The rack of the subject invention is suitable for this purpose. The rack is portable and may be placed upon the shelves or racks of a conventional dishwasher. The rack may also be placed in a pot of boiling water in order to sterilize the lids. The dishwasher or pot may therefore be used for this purpose; it is unnecessary to redesign them to make them suitable.

SUMMARY OF THE INVENTION

The rack of the present invention may be broadly described as including a frame having a plurality of up-standing dividers spaced apart from one another at regular intervals for receipt of objects to be washed. The rack includes a retainer having a pair of lateral supports pivotally mounted to the frame and a plurality of spaced bars attached to the supports and extending therebetween. The retainer swings from a closed position in which the bars are over the objects and prevent them from being removed from between the dividers to an open position in which the bars are beside the objects and allow them to be selectively inserted and removed from between the dividers. The rack also has means for releasably securing the retainer in the closed position.

DESCRIPTION OF THE DRAWINGS

The rack of the invention is described with reference to the accompanying drawings in which.

Like reference characters refer to like parts throughout the description of the drawings.

DESCRIPTION OF THE PREFERRED EMBODIMENT

With reference to Figure the rack of the invention, generally 10, has a pair of triangular-shaped legs 12*a, b* at opposite ends and a frame, generally 14, which extends between and interconnects the two legs. The frame is generally triangular in cross-section and has oppositely facing lower walls 16*a, b* and a number of up-standing dividers 18 spaced apart from one another at regular intervals along its length. A handle 20 extends upwardly from a point midway between the legs of the rack.

Figure 1:
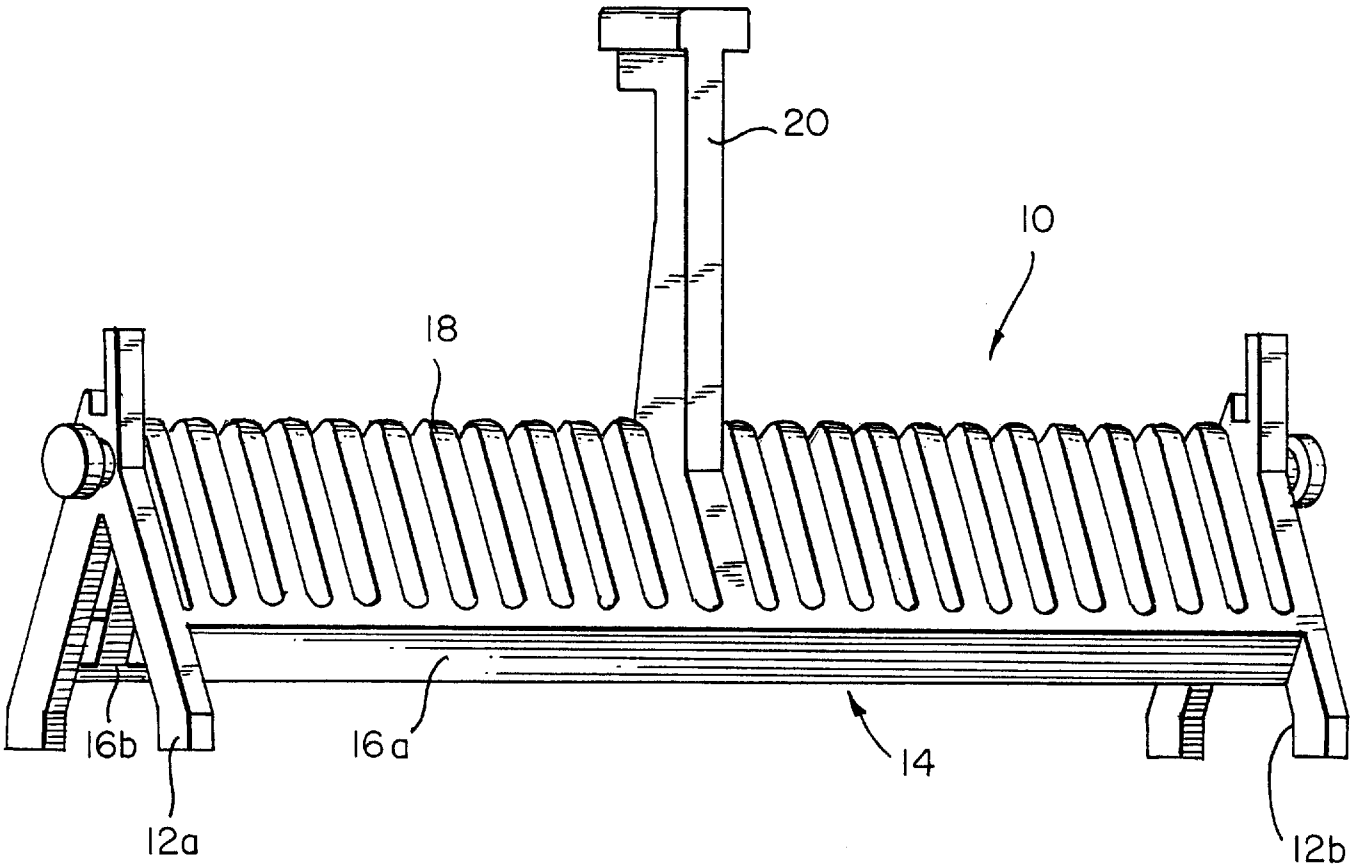
FIG. 1 is a perspective view of the lower portion of the rack.
Figure 2:
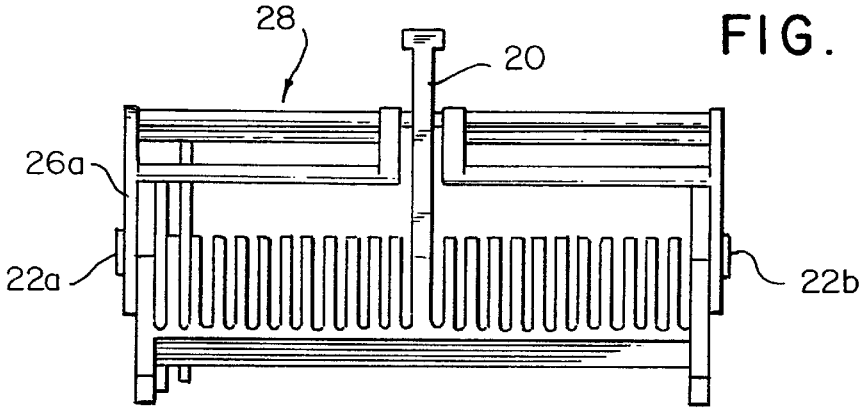
FIG. 2 is an elevation of the side of the rack in smaller scale.
Figure 5:
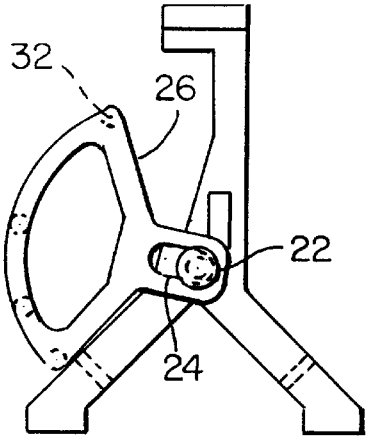
FIG. 5 is an elevation of a portion of the end of the rack.

With reference to FIGS. 2 and 5 a trunnion 22*a, b* extends outwardly from the vertex of each pair of legs. Each trunnion is received in an elongated slot 24 formed in the lateral support 26 of a retainer, generally 28. The end of each trunnion is enlarged to prevent the support from being removed from the trunnion.

Figure 3:
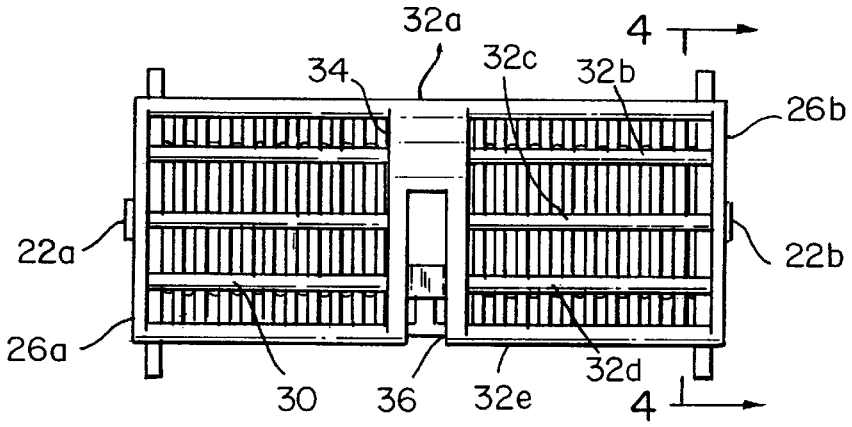
FIG. 3 is a plan view of the rack.

The retainer is made up of a pair of lateral supports 26*a, b* at each end of the rack and an intermediate framework 30. As illustrated in FIGS. 2 and 3 the framework is made up of an elongated bar 32*a* which runs from one support 26*a* to the other 26*b*. Shorter bars 32*b, c, d* and *e* extend from each support and terminate at an intermediate member 34. The bars are parallel to one another and are spaced an equal distance apart from adjacent bars. The intermediate member 34 is generally U-shaped and has an opening 36 for receipt of handle 20.

Figure 4:
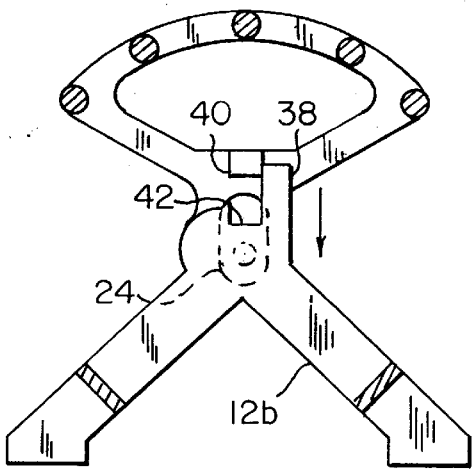
FIG. 4 is an elevation, in enlarged scale, on line 4—4 of FIG. 3.

With reference to FIG. 4, a stop member 38 extends upwardly from legs 12*b* and abuts against a boss 40 formed on the inside wall of the support. A groove 42 is formed in the upper wall of the legs for receipt of the boss when the support descends in the direction of the arrow.

Figure 6:
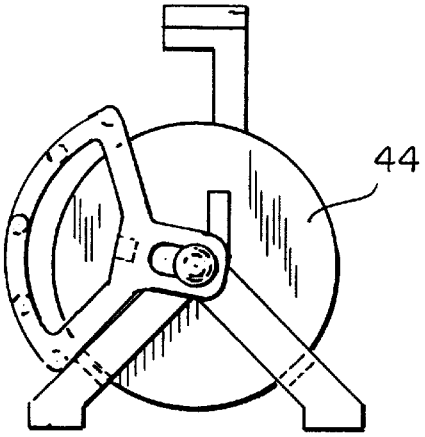
FIG. 6 is an elevation of the end of the rack showing its retainer in an open position.

With reference to FIGS. 5 and 6, the retainer is an open position where its bars 32 are beside the lids 44 to be washed. In this open position, the lids may be inserted downwardly into the spaces between adjacent dividers and lifted therefrom. The trunnion 22 is within slot 24 and the support may pivot about it. The support may also be moved linearly with respect to the trunnion by causing the trunnion to slide in the slot.

Figure 7:
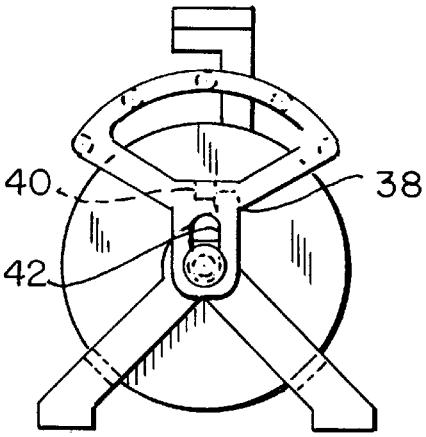
FIG. 7 is an elevation of the end showing the retainer closed.

In FIG. 7 the retainer has pivoted clockwise about the trunnion to a closed position where the bars are above the lids. The lids cannot be inserted or removed when the bars are above them. Boss 40 abuts against stop member 38 and prevents further clockwise pivoting. The boss is above groove 42 so that the retainer while closed is not locked.

Figure 8:
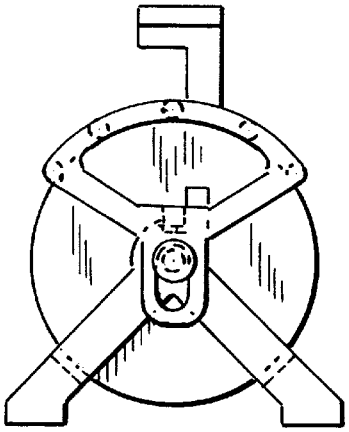
FIG. 8 is an elevation of the end showing the retainer closed and locked.

In FIG. 8, the support is in a lower position where its boss is within groove 42. In that position, the retainer is locked in the closed position and lids in the rack cannot be removed nor can new lids be added to the rack.

Lid 44 is intended to represent a smaller lid used to seal preserving jars. It should be noted however that the rack of the invention is capable of accommodating larger lids. As long as the lids are not so large that the retainer cannot be closed then the rack is capable of holding them.

It will be understood of course that modifications can be made in the preferred embodiments illustrated and described herein without departing from the scope and purview of the invention as defined in the appended claims. For example trunnions 22*a, b* may be mounted on lateral supports 26*a, b* and received in slots formed in legs 12*a, b.*

I claim:

1. A rack for retaining objects to be washed comprising:

a frame having a plurality of up-standing dividers spaced apart from one another at regular intervals for receipt of said objects therebetween;

a retainer having a pair of lateral supports pivotally mounted to said frame and a plurality of spaced bars attached to said supports and extending therebetween, said retainer swinging from a closed position in which said bars are over said objects and prevent them from being removed from between said dividers to an open position in which said bars are beside said objects and allow them to be selectively inserted and removed from between said dividers;

means for releasably securing said retainer in the closed position; and said frame having a trunnion about which said retainer pivots, said trunnion being received in a slot formed in each said lateral support.

2. The rack as claimed in claim 1 wherein said securing means includes a boss formed on at least one of said lateral supports and a groove formed on said frame for removably receipt of said boss, said boss securing said retainer in the closed position when within said groove.

3. The rack as claimed in claim 1, wherein said securing means includes a boss formed on at least one of said lateral supports and a groove formed on said frame for removable receipt of said boss, said boss being movable into and out of said groove as said trunnion slides in said slot, said boss securing said retainer in the closed position when within said groove.

4. A rack for retaining objects to be washed comprising:

a frame having a plurality of up-standing dividers spaced apart from one another at regular intervals for receipt of said objects therebetween, said frame further having a pair of trunnions, a stop member and a groove formed therein;

a retainer having a pair of lateral supports pivotally mounted to said frame and a plurality of spaced bars attached to said supports and extending therebetween, said supports each having a slot within which a respective one of said trunnions is slidably received, said retainer swinging about said trunnions from a closed position in which said bars are over said objects and prevent them from being removed from between said dividers to an open position in which said bars are beside said objects and allow them to be selectively inserted and removed from between said dividers, at least one of said supports having a boss which contacts said stop member when said retainer is in the closed position, said retainer when in the closed position being, with respect to said trunnions, selectively slidable downward to cause said boss to enter said groove and upward to withdraw said boss therefrom, said boss when in said groove, serving to secure said retainer in the closed position.

5. A rack for a dishwasher for retaining objects to be washed in the form of lids or other generally like-shaped items therein, said rack comprising:

a frame having a plurality of up-standing dividers spaced apart from one another at intervals for receipt of said objects therebetween, said frame further having a pair of trunnions, a stop member and a groove formed therein;

a retainer having a pair of lateral supports pivotally mounted to said frame and a plurality of spaced bars attached to said supports and extending therebetween, said supports each having a slot within which a respective one of said trunnions is slidably received, said retainer swinging about said trunnions from a closed position in which said bars are over said objects and prevent them from being removed from between said dividers to an open position in which said bars are beside said objects and allow them to be selectively inserted and removed from between said dividers, at least one of said supports having a boss which contacts said stop member when said retainer is in the closed position, said retainer when in the closed position being, with respect to said trunnions, selectively slidable downward to cause said boss to enter said groove and upward to withdraw said boss therefrom, said boss when in said groove, serving to secure said retainer in the closed position.

* * * * *